United States Patent [19]

Lewis et al.

[11] 4,044,652

[45] Aug. 30, 1977

[54] ELECTROHYDRAULIC PROPORTIONAL ACTUATOR APPARATUS

[75] Inventors: Leon David Lewis, Palos Verdes; Wilfried Wiher, Redondo Beach; Warde L. Parker, Rancho Palos Verdes, all of Calif.

[73] Assignee: The Garrett Corporation, Los Angeles, Calif.

[21] Appl. No.: 576,611

[22] Filed: May 12, 1975

[51] Int. Cl.[2] ..... F15B 9/10; F15B 13/044

[52] U.S. Cl. ..... 91/368; 91/375 R; 91/459

[58] Field of Search ..... 91/363 R, 363 A, 385, 91/386, 387, 459, 368, 358 R, 375 R

[56] References Cited

U.S. PATENT DOCUMENTS

| | | | |
|---|---|---|---|
| 2,789,543 | 4/1957 | Popowsky | 91/387 |
| 2,966,891 | 1/1961 | Williams | 91/387 |
| 3,087,470 | 4/1963 | Beard et al. | 91/363 R |
| 3,185,439 | 5/1965 | Inaba et al. | 91/375 R |
| 3,306,170 | 2/1967 | Kreuter | 91/385 |
| 3,739,813 | 6/1973 | Worden | 91/459 |

*Primary Examiner*—Paul E. Maslousky
*Attorney, Agent, or Firm*—Henry M. Bissell

[57] ABSTRACT

An electrohydraulic proportional actuator for converting an electrical input signal to proportional mechanical output. Fluid power may be derived from pressurized fuel or lubricating oil of an associated engine. The actuator may be used to drive any engine function requiring modulated control. The mechanical output is proportional to the electrical input. The actuator includes mechanical feedback to linearize the response function, thus eliminating the need for closed loop operation of the system in which the actuator is used. Both linear and rotary actuators are disclosed in various embodiments. Each type is capable of operation with either a proportional solenoid and valve or a force rebalance solenoid and valve.

10 Claims, 8 Drawing Figures

ELECTROHYDRAULIC PROPORTIONAL ACTUATOR APPARATUS

BACKGROUND OF THE INVENTION

1. Field of the Invention

This invention relates to electrohydraulic actuator systems and, more particularly, to such systems for positioning the nozzle of an associated turbine.

2. Description of the Prior Art

The development of a satisfactory gas turbine engine for automotive vehicle power depends to a significant extent upon the effectiveness of its control system. To compete successfully as an alternative to the already highly-developed piston engine as a vehicle power source, the gas turbine must not only be capable of comparable performance under all operating conditions, but preferably in a way and with a type of response which is familiar to the conditioned user of a piston engine-powered vehicle.

Most of the techniques required to satisfactorily control an automatic gas turbine are available from past experience with aircraft gas turbine engines. In a sense, the control system design may be more difficult because of the use by less sophisticated operators and the fact that is is practically necessary to cause the control system to simulate piston engine operation in the operator-machine interface. However, a more difficult problem is to realize the required control functions in devices which are acceptable on an economic basis for automotive utilization. Accordingly, many of the control devices and designs which are devised for use with gas turbine aircraft engines cannot be directly adapted to automotive use.

One of the particular control functions required for the automotive gas turbine engine is the positioning of the power turbine nozzles. Engine fuel flow and turbine nozzle position are controlled in response to various control and condition parameters such as accelerator pedal position, ambient temperature, ambient pressure, gas generator speed, gas generator turbine temperature, regenerator "hot side in" temperature, and transmission output shaft velocity. Because of the complexity of the control requirements, a computer is employed to operate with signals from a multiplicity of sensors and to develop the requisite control functions. Suitable actuators are required to operate in response to the computer control signals. Various types of electromechanical actuators are known, directed to a variety of output functions. Among these are the devices disclosed in the following U.S. Pats. Nos. :2,055,209 of Schaer; 2,256,970 of Bryant; 2,570,624 of Wyckoff; 2,696,196 of Adams et al; 2,738,772 of Richter; 2,886,010 of Hayos et al; 3,264,947 of Bidlack; and 3,380,394 of Fornerod. Such prior art is exemplary of the technology to which the present invention relates.

SUMMARY OF THE INVENTION

In brief, arrangements in accordance with the present invention comprise a servoactuator which is particularly adapted to position the turbine nozzles of a vehicle power turbine in response to electrical command signals. In the vehicular system for which the present invention is developd, the electrical signals are produced by a control computer operating in accordance with the characteristics of the system and in response to condition signals provided by various sensors. The design of the computer is no part of the present invention.

The servoactuators of this invention may be used in other systems and operated in response to signals derived from other sources. The servoactuators of the present invention produce an output motion in proportion to the input electrical control signals. In the particular vehicular turbine system with which these servoactuators are presently employed, the output movement of the servoactuator acts through a suitable linkage mechanism to drive a ring gear which in turn rotates the power turbine nozzles through the desired angular travel. In this system, nozzle position is modulated between 0° and 20° as a function of regenerator or gas generator inlet temperature during steady-state operation. Particular angular settings of the nozzles are specified during acceleration, deceleration and startup, in which case the idle and steady-state conditions are overridden. In addition, the actuators may be used to reverse the nozzles by positioning them in a braking mode so that some braking of the vehicle is actually attained from the turbine.

In one particular arrangement in accordance with the present invention, the servoactuator comprises a hydraulic motor having an output shaft for coupling to the ring gear which is connected to position the turbine nozzles. Movement of the hydraulic motor is controlled by a hydraulic servo valve which is actuated by a proportional solenoid. A lever is pivotably anchored at one end and is pivotably connected to the protruding rod of the hydraulic motor at the other end. A second rod, which protrudes from the proportional solenoid coil portion, is pivotably mounted intermediate the ends of the lever such that the motion of the hydraulic motor piston causes a translation of the solenoid and valve, thereby providing a follow-up mechanism for the servoactuator which serves to linearize the response of the servoactuator.

In accordance with particular aspects of the present invention, the servoactuator comprises a main body housing a hydraulic four-way valve, a transducer, and a piston so arranged as to provide linear movement of an output shaft attached to the piston which is proportional to an electrical input signal. The output shaft is arranged for coupling to a load which, in the vehicular turbine system described, is a ring gear coupled to rotate the turbine nozzles through the desired angular travel. The servo valve comprises a proportional solenoid-type, linear motion transducer and a high-gain, four-way hydraulic valve. The solenoid plunger has a conically-shaped face in order to minimize the range of operating force with travel. A hole through the plunger may be provided to control damping and thereby stabilize the valve spool. The plunger is spring-loaded and develops a travel which is proportional to input current to the solenoid coil.

In another arrangement in accordance with the present invention, a rotary actuator is employed, coupled to be driven by a rotary solenoid. The rotary actuator has a rotational output shaft for providing rotary output motion which is linearly proportional to an electrical input signal to the rotary solenoid. The position of the actuator is controlled by a rotary valve, the shaft of which is coupled to the rotary actuator by a follow-up spring. The rotary valve shaft is connected to the rotary solenoid shaft by a load spring such that when the actuator is in the "null" position, the load spring and follow-up spring are balanced in tension against each other.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENTS

Figure 1:
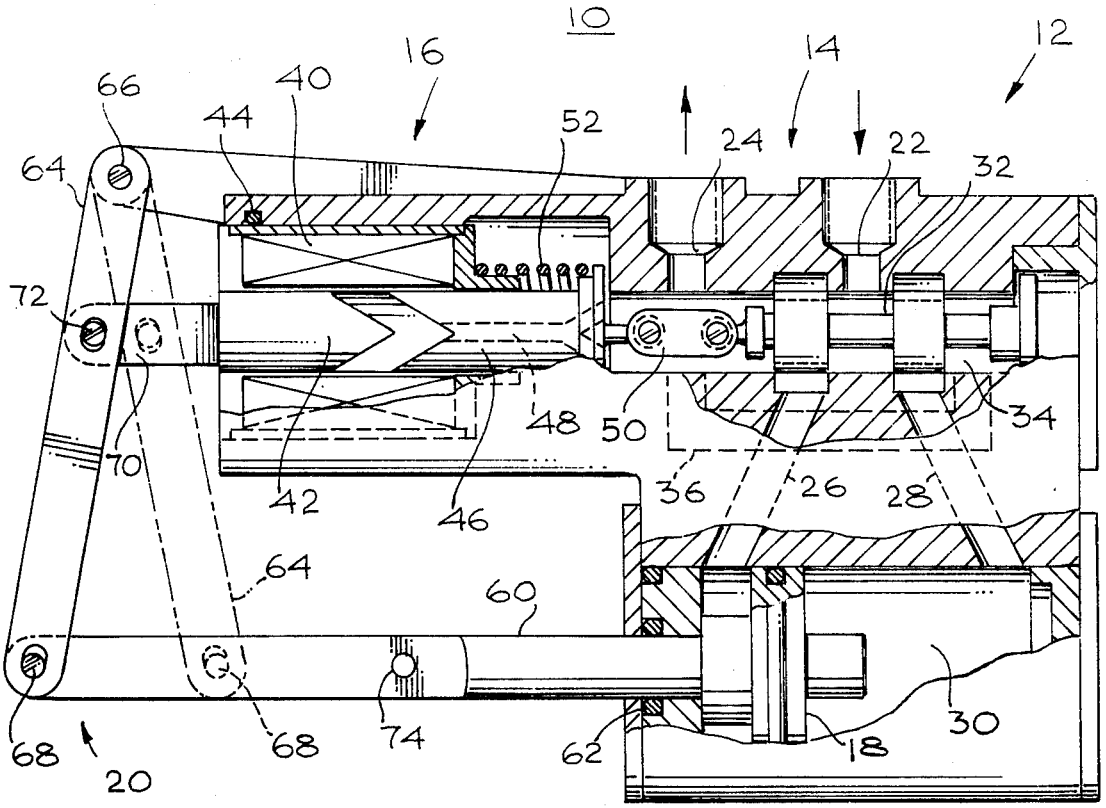
FIG. 1 is a front elevational view, partially broken away, of one particular arrangement in accordance with the present invention.

Referring to FIG. 1, a particular linear servoactuator 10 in accordance with the invention is shown comprising a main body or housing 12 which houses a four-way hydraulic valve 14, a proportional solenoid 16 and a piston 18. A follow-up linkage 20 connects the proportional solenoid 16 and piston 18, thus providing an output which is linearly proportional to the electrical signal input solenoid.

The hydraulic valve 14 has an inlet line 22 for connection to a supply of pressurized fluid (not shown) and an outlet 24 for connection to a fluid return line. Internal fluid lines 26 and 28 connect from the valve 14 to opposite sides of the piston 18 within its cylinder 30. A spool 32 is mounted to move laterally within the valve chamber 34 to admit pressurized fluid from the inlet 22 to a selected one of the internal lines 26, 28. Another internal line 36 connects the portion of the chamber 34 on the right-hand side of the spool 32 with the portion of the chamber on the left-hand side of the spool 32 to which the outlet 34 is connected.

The solenoid 16 comprises a coil 40 attached to a core 42 which is movable within the housing 12 in sealing relationship provided by a seal 44. The solenoid 16 has a plunger 46 shown with a central port 48. The plunger 46 is connected to the spool 32 by means of a link 50. The proportional solenoid is loaded by a compression spring 52 extending between adjacent faces of the coil 40 and the plunger 46 to provide a feedback force. The direct connection between the solenoid plunger 46 and the valve spool 32 via the link 50 provides zero backlash and simultaneously accommodates the close clearance of the spool valve. The plunger 46 operates in the fluid return passage of the servoactuator body, thus providing minimum operating force for plunger 46 and the valve spool 32. The hydraulic seal 44 for the solenoid is at the outer diameter of the coil 40, and the force for follow-up motion is provided by the piston 18. Since the valve 14 has a high-pessure gain, the error introduced to overcome seal friction is very small.

Coupled to the piston 18 is an output shaft 60 which is sealed within the housing 12 against leakage by means of the seal 62. The follow-up linkage 20 comprises a lever 64 which is pivotably anchored to the housing 12 at a pivot point 66 and is also pivotably connected to the shaft 60 at pivot point 68 and to a shaft extension 70 of the solenoid core 42 at pivot point 72. Coupling to the shaft 60 to drive the associated turbine nozzle ring gear (not shown) may be afforded via a coupling point 74. The phantom outline of the lever 64 shows the position of the linkage 20 corresponding to the movement of the piston 18 to the extreme right-hand position within the cylinder 30.

In the operation of the arrangement of FIG. 1, the system begins in a stable condition with the spool 32 closing off the fluid lines 26, 28 for a given level of input signal to the solenoid 16. As signal current is increased, a point is reached where the preload of the spring 52 is overcome by the electromagnetic force on solenoid plunger 46. This moves the servovalve spool 32 to the left, causing hydraulic fluid to flow from the pressurized fluid inlet 22 into the line 26 extending to the output shaft side of the piston 18. The piston 18 responds by moving to the right in the cylinder 30, thereby, by virtue of the linkage 20, also moving the solenoid core 42 and coil 40 toward the right. This causes the servovalve spool 32 to return to the null position, thereby closing off the lines 26, 28 and stopping the piston 18 at the new position. Further increase in signal current will cause the piston 18 to continue to the right by an amount proportional to the increase in signal currnt. Reduction in signal current causes the piston 18 to move to the left in similar manner.

In one particular embodiment of the invention corresponding to FIG. 1, the piston 18 is provided with a stroke of 2.50 inches and provides a force of 100 lbs. maximum with 100 psi supply pessure. Under maximum slew rate of 2.5 inches in 0.10 seconds, the actuator 10 provides a 15 lb. output force. Full actuator travel of 2.50 in. is equivalent to 90° total nozzle blade angle change. A piston diameter of 1.32 in. serves to meet the design maximum of 100 lb. output force. The solenoid plunger 46 has a travel of 0.50 in. in which its motion is proportional to input current to the coil 40. The four-way valve 14 develops the maximum slew rate with a travel of 0.04 in. of the spool 32. A selected size of the plunger port 48 serves to provide effective damping of the internal control system of the servoactuator.

Figure 2:
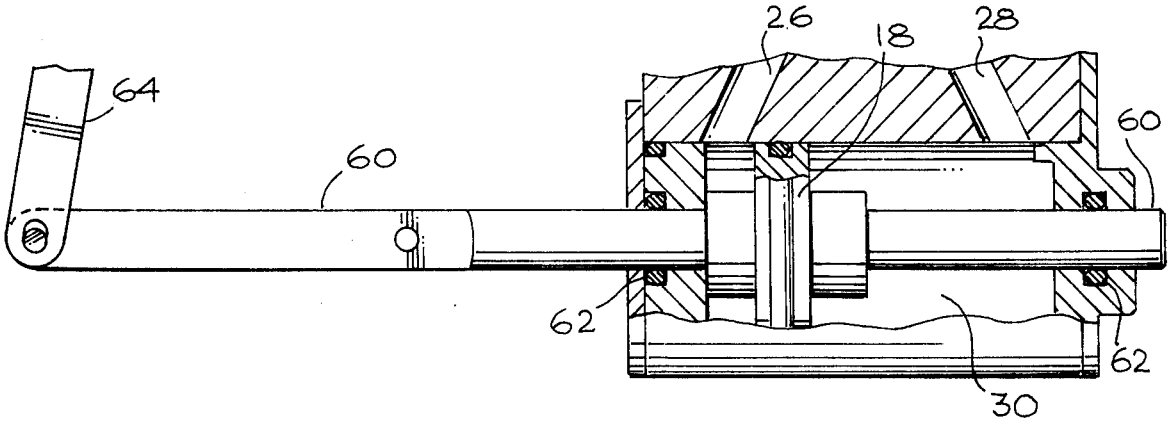
FIG. 2 is a similar view of a portion of the device of FIG. 1, showing a particular modification thereof.

FIG. 2 shows the cylinder portion of the arrangement of FIG. 1 with a minor modification in which the output shaft 60 extends out both ends of the cylinder 30 so that the drive coupling to the associated turbine nozzle ring gear may be effected at the right-hand end of the cylinder 30. In all other respects, the operation of a servoactuator corresponding to FIG. 2 would be the same as indicated for the actuator of FIG. 1.

Figure 3:
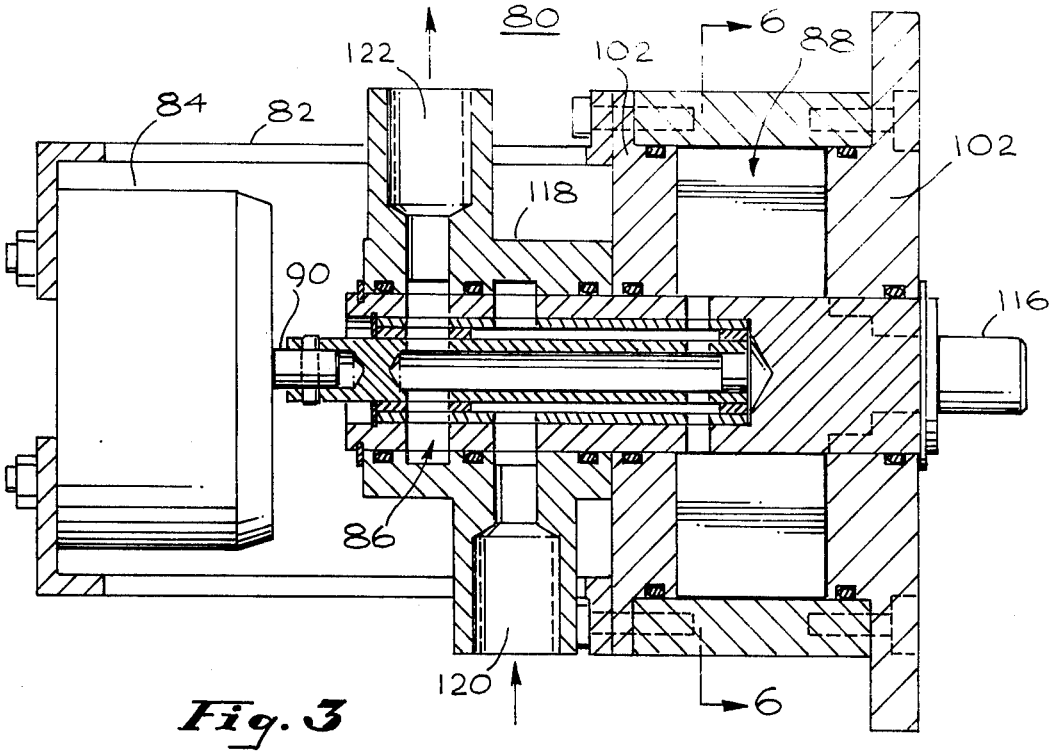
FIG. 3 is a similar view in longitudinal cross-section of another particular arrangement in accordance with the present invention.
Figure 4:
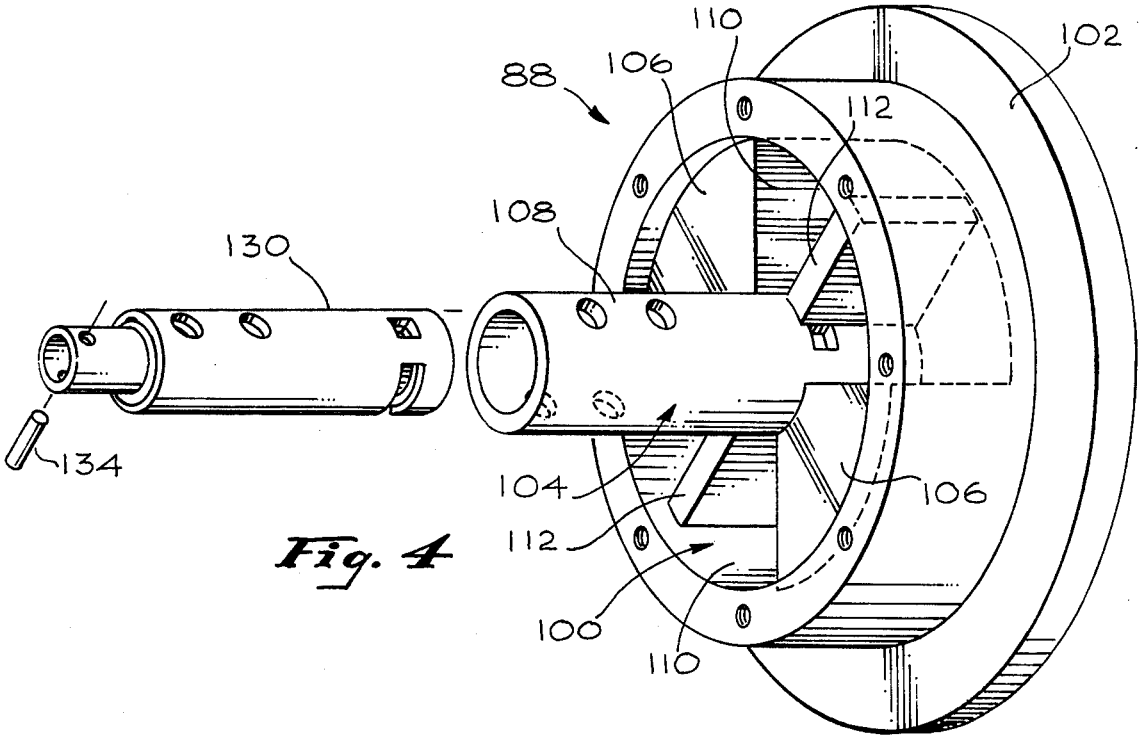
FIG. 4 is a partially-exploded view, in perspective, of a portion of the arrangement of FIG. 3.
Figure 5:
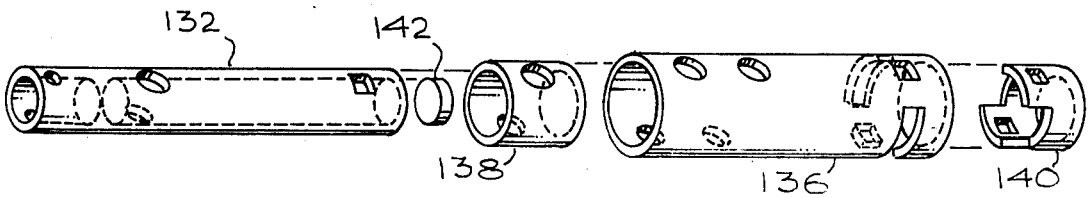
FIG. 5 is an exploded view of a portion of FIG. 4.

The embodiment of the invention represented in FIGS. 3, 4 and 5 comprises a rotary actuator 80 of the proportional solenoid type. As indicated in FIG. 3, the actuator 80 comprises a housing 82 containing a rotary solenoid 84, a valve assembly 86 and a drive assembly 88. The rotary solenoid 84 is of a type known in the art and may be purchased from Ledex, Inc., 123 Webster Street, Dayton, Ohio. It acts to provide a direct rotation of its output shaft 90 in response to electrical input signals.

The drive assembly 88 is shown more clearly in FIG. 4 as comprising a cylinder 100 between end plates 102 (see FIG. 3) that guide a dual-vane rotor 104 designed to travel through an angle of 90°. Two abutments 106, diametrically opposite from each other, are permanently attached to the inner walls of the cylinder 100 and form a close fit to the shaft 108 of the rotor 104. The abutments 106 serve as stops for angular travel of the rotor 104 and form two separate chambers 110 within which the two vanes 112 of the rotor 104 travel. The rotor output shaft 116 extends through the righthand plate 102, which also serves as a mounting plate for the unit 80. The rotary shaft 108 also extends to the left-hand plate 102 and through a swivel manifold 118 (FIG. 3) that directs fluid into and out of the cylinder 100. Inlet 120 and outlet 122 conduct fluid between the swivel manifold and a source of pressurized fluid. The swivel manifold 118 remains fixed with respect to the housing 82 and allows the free flow of fluid during the full angular travel of the rotor 104.

The servovalve assembly 86 comprises a servovalve spool 130 (see FIGS. 4 and 5) having an inner shaft 132 drilled at the right-hand end for the hydraulic fluid return passage and at the left-hand end for coupling to the solenoid shaft 90 by means of a pin 134. The servovalve spool 130 also includes an outer sleeve 136, tubular spacers 138 and 40 for manifolding of the hydraulic fluid, and a plug 142 for mounting in the hollow section of the inner shaft 132. The supply passage of the servovalve spool 130 is between the inner diameter of the outer sleeve 136 and the outer diameter of the inner shaft 132.

Figure 6:
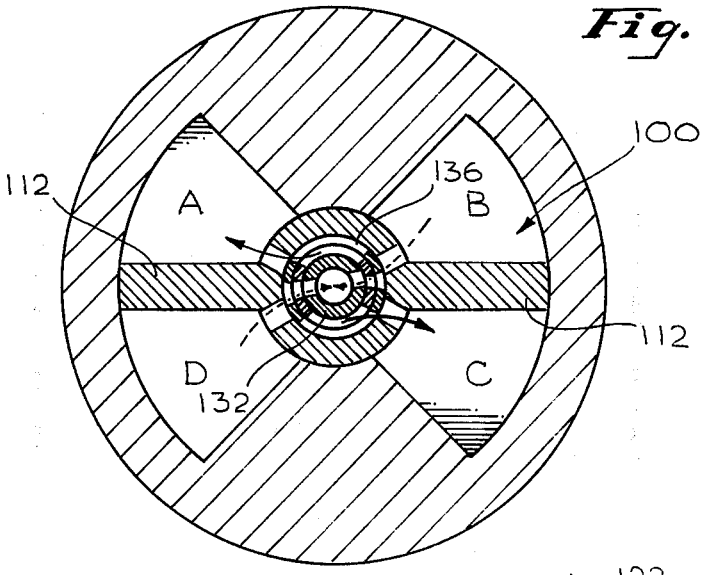
FIG. 6 is a schematic representation illustrating the fluid flow in the device of FIGS. 3 and 4.

The operation of the rotary actuator of FIGS. 3–5 may be better understood by reference to FIG. 6, which is a cross-sectional view taken along the line 6—6 of FIG. 3, looking in the direction of the arrows. When the servoactuator 80 is in the static mode, pressure is equalized in the chambers A, B, C and D of the cylinder 100. However, when the servovalve assembly 86 is positioned as shown in FIG. 6 to develop the actuator in the pressurized mode, pressure is directed to the chambers A and C from the spaces between the sleeve 136 and the shaft 132. At the same time, porting is arranged to permit the connection of the chambers B and D to the return via the hollow section of the shaft 132. As a result of the pressure differential across the rotor vanes 112 (supply pressure in chambers A and C, zero pressure in chambers B and D), the vanes 112 cause a counter-clockwise rotational movement which is coupled to the output shaft 116. Movement of the rotor 108 in this fashion brings the spool assembly 86 to a position where the fluid ports are again closed, thus maintaining the position of the rotors 112 and output shaft 116 as determined by the solenoid shaft 90 in response to a given electrical signal current level in the solenoid 84. Increased solenoid current causes a further rotation of the solenoid shaft 90, a corresponding rotation of the valve spool assembly 86, again creating a differential pressure condition across the vanes 112 in the cylinder 100, thereby developing further rotation of the vanes 112 and the output shaft 116 to the new position determined by the level of current in the solenoid 84. Reduction of current level in the solenoid 84 causes a differential pressure across the vanes 112 in the opposite direction and a resulting rotation of the vanes 112 and output shaft 116 in the clockwise direction of FIG. 6.

Close working clearances are provided between the ends of the vanes 12 and the inner cylinder walls, between the left and right-hand sides of the vanes and the cylinder side plates, and between the inner diameter of the abutments 106 and the rotor shaft 108 to minimize leakage through these clearances during operation. Proper fit between the ends of the vanes 112 and the inner wall of the cylinder 100 requires close control of concentricity of all mating parts. Spring-loaded slippers can be provided on the ends of the vanes 112 to minimize leakage with relaxed machine tolerances if desired. Clearances between the left and right-hand edges of the vanes 112 may be controlled by shimming adjacent the flanges of the cylinder end plates 102.

Figure 7:
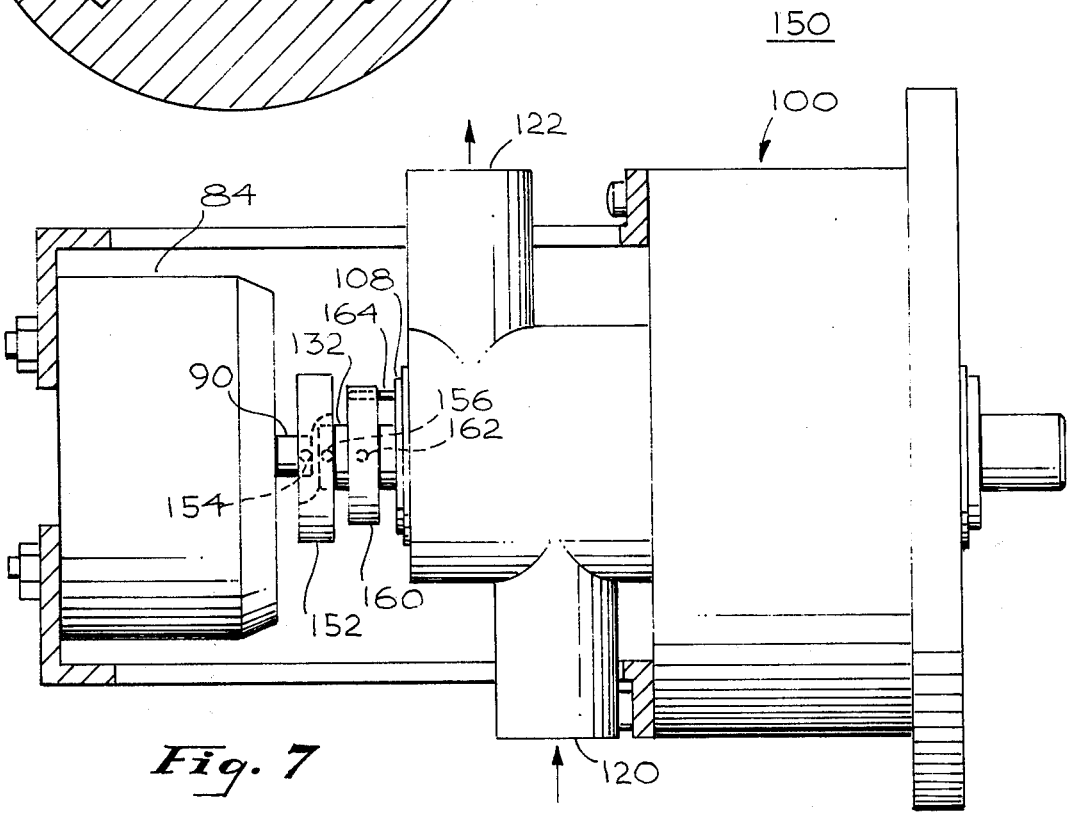
FIG. 7 is a front elevational view of still another arrangement in accordance with the invention.
Figure 8:
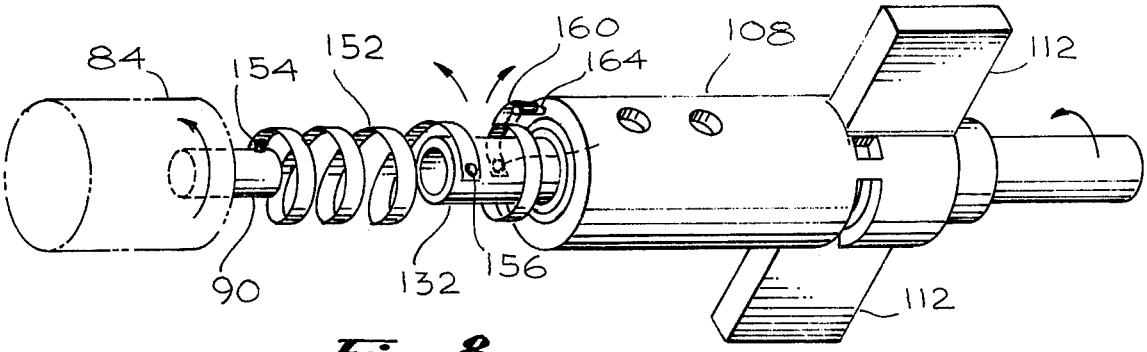
FIG. 8 is an exploded view of the spring feed back system arrangement of FIG. 7.

FIGS. 7 and 8 illustrate a rotary actuator in accordance with the invention which is essentially the same as that shown and described in connection with FIGS. 3–6, except that a torsion load spring is interposed as the connection between the rotary solenoid shaft 90 and the shaft 132 of the rotary valve assembly 86. Also, a follow-up spring is inserted to provide a connection between the rotary valve assembly 86 and the vane rotor shaft 108. The resulting rotary actuator 150 of FIG. 7 provides a force balance system in which the load spring 152, connected to the solenoid shaft 90 by pin 154 and to the valve shaft 132 by pin 156, and the follow-up spring 160, connected to the shaft 132 by a pin 162 and to the vane rotor 108 by pin 164, are balanced in tension against each other in the null position. Angular travel of the rotor 108 proportional to current input to the solenoid 84 is attained by proper matching of the solenoid characteristics and the rate of the load spring 152.

By virtue of the particular arrangements in accordance with the present invention as shown in the accompanying drawings and described hereinabove, improved proportional response operation is afforded in both the linear and rotary actuators of the present design. These actuators are particularly designed for and may be used to advantage in the turbine nozzle positioning systems for an improved and simplified automotive vehicle turbine propulsion system. The inherent linearization of these actuators enables the turbine nozzle control system to be operated without the need for the provision of closed loop control, thus substantially reducing the cost and complexity of the turbine control system so that turbine propulsion becomes a more viable alternative to the conventional piston engine for automotive vehicle propulsion.

Although there have been described above specific arrangements of electrohydraulic actuators in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Electrohydraulic proportional actuator apparatus comprising:

a housing;

a double-acting fluid-responsive motive member having an output shaft coupled for movement therewith;

means for admitting pressurized fluid to develop a differential pressure across said motive member, said means including a valve movable between a null position and respective flow positions for applying pressure to one side or the other of said motive member;

a solenoid coupled to drive said valve to a selected flow position corresponding to an incremental change of current level in the solenoid; and means responsive to the movement of the motive member for restoring the valve to its null position upon the motive member reaching a position corresponding to the level of current in the solenoid;

wherein said valve comprises a spool valve having a spool member translatable along an axis within a valve chamber; wherein the solenoid comprises a support frame mounting an integral coil and core adapted for translatable movement along the translation axis of said spool member, and a plunger connected to the spool member; and wherein the movement-responsive means comprises a link pivotably anchored to the housing and pivotably connected respectively to said motive member and to said solenoid frame to cause translation of the coil and core in proportion to the movement of the motive member.

2. Apparatus in accordance with claim 1 further including means for biasing the plunger away from the solenoid support frame.

3. Apparatus in accordance with claim 2 wherein the support frame and the plunger are provided with opposed facing surfaces, and wherein the biasing means comprises a compression spring extending between the opposed surfaces.

4. Apparatus in accordance with claim 1 wherein the spool member divides the valve chamber into a pressure fluid section and a return fluid section and wherein the portion of the housing enclosing the solenoid inlcudes a space communicating directly with the return fluid secton, the solenoid plunger being operative within said space.

5. Apparatus in accordance with claim 4 further including a seal member mounted between the housing and the solenoid in order to permit translatable movement of the solenoid frame relative to said space.

6. Apparatus in accordance with claim 4 wherein the plunger includes an aperture extending therethrough for permitting the flow of fluid from one side of the plunger to the other during relative movement between the plunger and the solenoid frame.

7. Apparatus in accordance with claim 6 wherein the aperture is selectively sized to provide damping of the movable elements of the apparatus.

8. Apparatus in accordance with claim 1 wherein the link has a first end pivotably anchored to the housing and a second end remote therefrom, wherein the motive member includes a first output shaft pivotably connected to said second end, and further including means for pivotably connecting the solenoid frame to the link at a point between the two ends thereof.

9. Apparatus in accordance with claim 8 wherein the motive member comprises a piston movable within a cylinder positioned within the housing and a second output shaft extending from an end of said cylinder remote from the first output shaft.

10. Electrohydraulic proportional actuator apparatus comprising:

a housing;

a double-acting fluid-responsive motive member having an output shaft coupled for movement therewith;

a spool valve having a spool member translatable along an axis within a valve chamber between a null positin and respective flow positions for applying pressure to one side or the other of said motive member;

a solenoid coupled to drive said spool member to a selected flow position corresponding to an incremental change of current level in the solenoid, the solenoid comprising a support frame mounting an integral coil and core adapted for translatable movement along the translation axis of said spool member and a plunger connected to the spool member; and a link pivotably anchored to the housing and pivotably connected respectively to said motive member and to said solenoid frame to cause translation of the coil and core in proportion to the movement of the motive member, thereby restoring the spool member to the null position.

* * * * *